US005121823A

United States Patent [19]

Wanzl et al.

[11] Patent Number: 5,121,823

[45] Date of Patent: Jun. 16, 1992

[54] COIN LOCK FOR A TROLLEY

[75] Inventors: Rudolf Wanzl, Leipheim; Karl Ertle, Langenau, both of Fed. Rep. of Germany

[73] Assignee: Wanzl GmbH & Co., Leipheim, Fed. Rep. of Germany

[21] Appl. No.: 623,965

[22] PCT Filed: Apr. 17, 1990

[86] PCT No.: PCT/EP90/00593

§ 371 Date: Nov. 28, 1990

§ 102(e) Date: Nov. 28, 1990

[87] PCT Pub. No.: WO90/13098

PCT Pub. Date: Nov. 1, 1990

[30] Foreign Application Priority Data

Apr. 19, 1989 [DE] Fed. Rep. of Germany ..... 3912831

[51] Int. Cl.[5] ..... G07F 5/02

[52] U.S. Cl. ..... 194/253; 194/905; 194/259

[58] Field of Search ..... 194/905, 253, 259, 205, 194/212

[56] References Cited

U.S. PATENT DOCUMENTS

| | | | |
|---|---|---|---|
| 4,635,782 | 1/1987 | Wieth et al. | 194/905 X |
| 4,691,816 | 9/1987 | Trubiano | 194/905 X |
| 4,766,989 | 8/1988 | Maloeuvre et al. . | |
| 5,040,656 | 8/1991 | DiPaolo et al. | 194/905 X |

FOREIGN PATENT DOCUMENTS

| | | | |
|---|---|---|---|
| 2554916 | 12/1985 | Fed. Rep. of Germany . | |
| 3519167 | 12/1986 | Fed. Rep. of Germany . | |
| 3605055 | 8/1987 | Fed. Rep. of Germany . | |
| 3900538 | 7/1990 | Fed. Rep. of Germany . | |
| 3900582 | 7/1990 | Fed. Rep. of Germany . | |
| 3508772 | 10/1986 | France | 194/905 |
| WO80/00888 | 5/1980 | PCT Int'l Appl. . | |
| 8604174 | 7/1986 | PCT Int'l Appl. . | |
| WO88/01084 | 2/1988 | PCT Int'l Appl. . | |

*Primary Examiner*—Robert J. Spar
*Assistant Examiner*—William M. Hienz
*Attorney, Agent, or Firm*—Stevens, Davis, Miller & Mosher

[57] ABSTRACT

A coin slide (11) bearing a coin is movable into a casing (2) of a coin lock (1) to release a locking member (14) and allow full insertion of the coin slide (11). In this position a space (recess 20) in the coin slide (11) is aligned with a space (aperture 21) in a coupling member (8) and with a space (aperture (19) in a casing position separating the coin slide (11) and the coupling member (8). A locking member (e.g. ball 18) in the apertures (19 and 21) may now be moved upwardly, on pulling of the coupling member (8), to occupy the recess (20) and the aperture (19) so as to allow complete withdrawal of the coupling member (8), e.g. to free a shopping trolley. The coin is released by reversing the procedure on re-insertion of the coupling member (8).

17 Claims, 3 Drawing Sheets

COIN LOCK FOR A TROLLEY

BACKGROUND OF THE INVENTION

The present invention relates to a coin lock for a trolley intended for attachment to the coin lock of a further, trolley, e.g. at a trolley collection point.

In a known coin lock a casing is provided with a coin slide and with a coupling member arranged so as to be movable at an angle to each other. Locking members arranged inside the casing act upon the coin slide and the coupling member and, when the coin slide containing a coin is inserted into the casing, allow the coupling member to be released and the coin slide to be locked so as to prevent removal of the coin. When the released coupling member is re-inserted into the coin lock casing it moves a locking member in the direction of sliding of the coupling member to release the coin slide and free the coin; withdrawal of the coin slide locks the coupling member in the casing.

Coin locks of this type have become widespread, and they are frequently used on shopping trolleys in self-service stores. The shopping trolleys, nested in rows and attached to one another, are available to the customer on payment of a deposit. If the customer wishes to remove the last trolley of a row of nested shopping trolleys, he must insert a coin into the coin lock mounted on the shopping trolley. This then releases the connection in the form of a flexible coupling member between the last trolley and the preceding trolley, and the last trolley can be removed. When the customer brings the shopping trolley back again to one of the return positions provided, he pushes it into a trolley already there, he then attaches it to that trolley by inserting the coupling member on that trolley into the opening in the coin lock of his returned trolley, and retrieves his inserted coin again.

A coin lock of this type is described, for example, in European Patent Specification 0 070 997 and its equivalent U.S. Pat. No. 4,635,782. Although this coin lock has proved successful, it does have a significant disadvantage in that it is relatively large. When this coin lock is attached to the handle of a shopping trolley, this can cause an obstruction for a small child sitting in a child's seat fitted to the shopping trolley near the handle. The relatively large shape of this coin lock is due to the fact that the coin slide has a relatively long bar fixed thereto, and in the coupling position of the coin lock the coupling member has to engage an additional stationary part in the casing in order to lock the coin slide. The length of the bar corresponds approximately to the length of a coin-receiving portion in the coin slide, and a space required for the insertion or withdrawal of the coupling member is formed between the coin-receiving portion and the free end of the bar. In addition, there is a further space between the end of the coin slide in the casing and an opposing casing wall in which a compression spring acting upon the coin slide is provided for ejection thereof. The length of the coin slide and the further space for receiving the compression spring determines the minimum structural size of this coin lock.

SUMMARY OF THE INVENTION

An object of the present invention is to provide a coin lock as described above but having a substantial reduction in structural size.

This object is attained according to the invention in that the casing comprises a fixed portion separating the coin slide and the inserted coupling member at an area of intersection and overlapping thereof and having a space therein accommodating a movable locking member, the locking member engaging a space in the inserted coupling member for locking thereof on release of the coin slide and being movable out of the space of the coupling member towards the fully inserted coin slide when a withdrawal force is applied to the inserted coupling member.

In a preferred embodiment the locking member is merely a ball of approximately 7 mm in diameter, whereas the length of the locking member bar of the prior-art coin lock described above is at least 6 times the diameter of the ball. This dimensional comparison alone clearly demonstrates the substantial reduction of the structural size which is possible in the case of the proposed coin lock on account of the proposed locking member. In addition, in the case of the coin lock according to the invention the previously-described space required for the insertion and withdrawal of the coupling member and increasing the width of the coin lock can advantageously be dispensed with. Thus, the coin lock according to the invention may be substantially smaller than known coin locks.

BRIEF DESCRIPTION OF THE DRAWINGS

An embodiment of the invention will be described by way of example only with reference to the accompanying drawings, wherein.

DETAILED DESCRIPTION OF A PREFERRED EMBODIMENT

Figure 1:
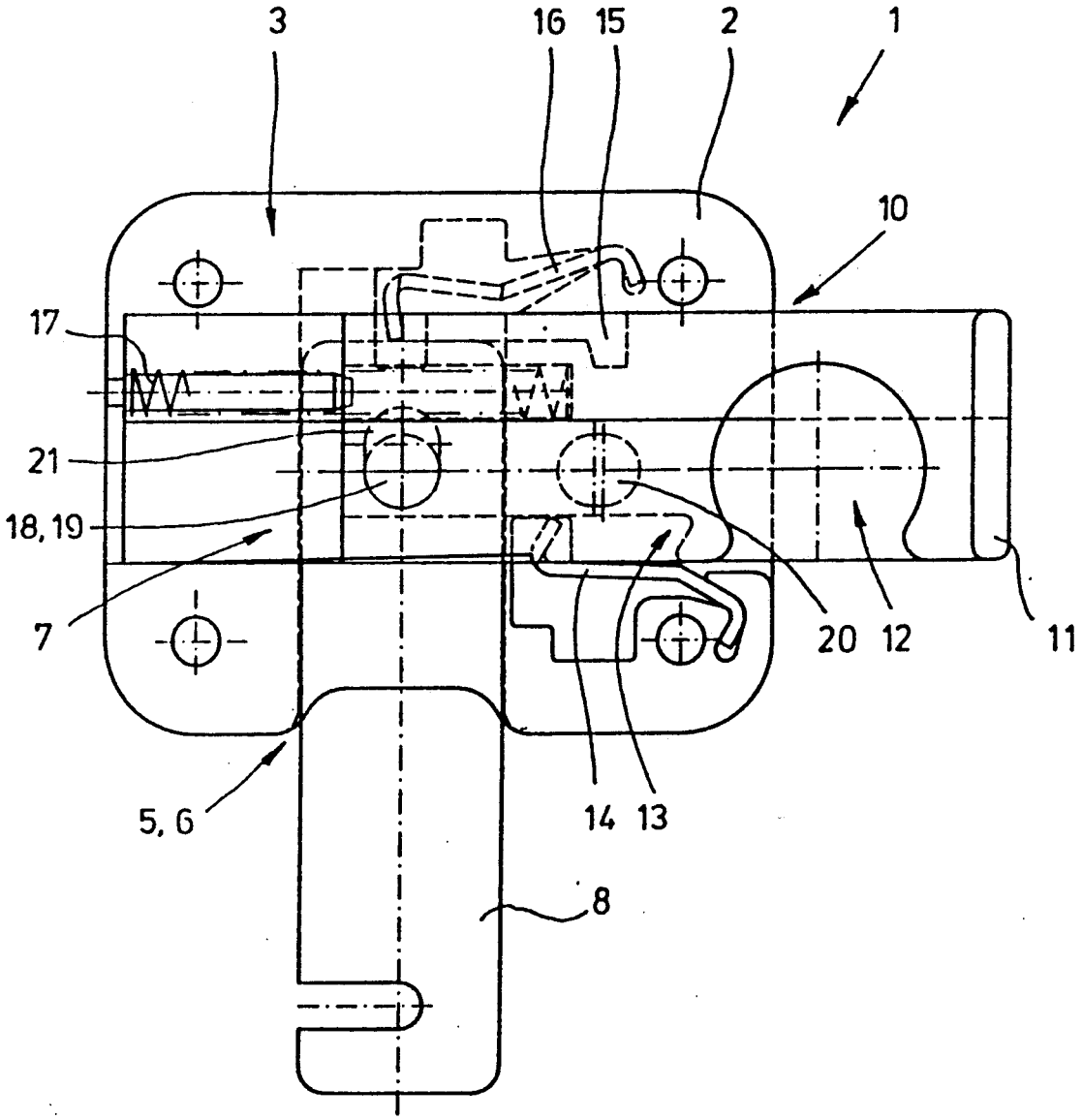
FIG. 1 is a plan part-sectional view of a coin lock with the coupling member locked and the coin slide ready to receive a coin.

In the drawings, a coin lock 1 comprises a casing 2 to which a cover (not shown) can be attached by screws.

The casing 2 contains a stationary casing portion 3 formed as an intermediate floor between the top and bottom of the casing. The underside of the stationary casing portion 3 is provided with a slideway or slot 6 for slidably receiving a secondary coupling member 8 of a further coin lock of an adjacent shopping trolley. An opening 5, which permits the insertion of the secondary coupling member 8 into the slot 6, is provided in the side wall of the casing 2. A similar primary coupling member 8 is preferably flexibly attached to the coin lock 1, for example by means of a chain or a plastics-coated steel wire. The manner of attachment of the primary coupling member 8 is preferably such that the primary coupling member 8 cannot be inserted into its own coin lock 1, but only into the coin lock of an adjacent trolley. Alternatively, the primary coupling member 8 may be mounted stationary on the coin lock 1, but this has not been found in the past to be particularly advantageous with similar coin locks. The known manner of attachment of the primary coupling member 8 to the coin lock 1 is not separately shown in the drawings.

Receiving means 10 in the form of a guideway or guide slot for a coin slide 11 are provided at right angles to the slot 6 along the top of the stationary casing portion 3. The coin slide 11 and the slideway or slot 6 for coupling member 8 are therefore inclined to each other at right angles and they are situated on different planes separated by a fixed portion of the stationary casing 3. Stated another way, the slideway 6 and the guideway 10 are on opposite sides of a common plane (the fixed portion). The coin slide 11 has a horizontal receiving portion in the form of a coin recess 12 into which a coin may be inserted. A spring-loaded locking member 14 is provided adjacent the coin slide 11, and on engagement with a recess 13 provided in the coin slide 11 prevents full insertion of the coin slide 11, and hence release of the coupling member 8, unless the coin slide 11 contains a coin. A further spring-loaded locking member 16 engageable with the other side of the coin slide 11 is similarly arranged opposite the locking member 14 on the casing portion 3.

When the coin slide 11 containing a coin is pushed into the casing 2, against the action of a compression spring 17 in the casing 2, the locking member 16 engages in a groove 15 formed in the coin slide 11 and prevents the coin slide 11 from springing out of the casing 2 again. The coin lock 1 is shown in FIG. 1 in such a way that the secondary coupling member 8 of another coin lock is locked with the coin lock 1 and the coin slide 11 projects sufficiently far out of the casing 2 that a coin may be inserted into the coin recess 12. In this position two trolleys are coupled to each other.

The casing portion 3 is provided in an area 7 at the intersection of the coin slide 11 and the coupling member 8 with a space in the form of an aperture 19 in which a locking member 18, preferably a ball of e.g. 7 mm in diameter, may be inserted. A space, for example, in the form of an upwardly-orientated opening or recess 20, is provided on the underside of the coin slide 11, and the coupling member 8 is provided with an aperture 21 in the form of an elongate hole. In addition, the recess 20 in the coin slide 11 has, viewed from above, the preferred shape of an elongate depression.

In FIG. 1 the spherical locking member 18 is accommodated not only in the aperture 19 of the casing portion 3, but also partially engages in the aperture 21 of the coupling member 8 and rests on the base 4 of the casing 2. The aperture 21 of the coupling member 8 is covered at the top by the coin slide 11. The thickness of the coupling member 8, barely half the diameter of the locking member 18, and the thickness of the casing portion 3 are each less than the diameter of the spherical locking member 18, while the total thickness of the coupling member 8 and the casing portion 3 is slightly greater than the diameter of the spherical locking member 18, which is arranged with play in the aperture 19 and 21. In this position, it is not possible to withdraw the coupling member 8 from the coin lock 1 since, as soon as a tensile force acts upon the coupling member 8, the locking member 18 is pressed by an end wall of the aperture 21 of the coupling member 8 against the underside of the coin slide 11. Since in this case the spherical locking member 18 is able to move only very slightly upwards, it forms a lock for the coupling member 8. The locking member 18 may alternatively be constructed as a roller with semicircular ends.

Figure 2:
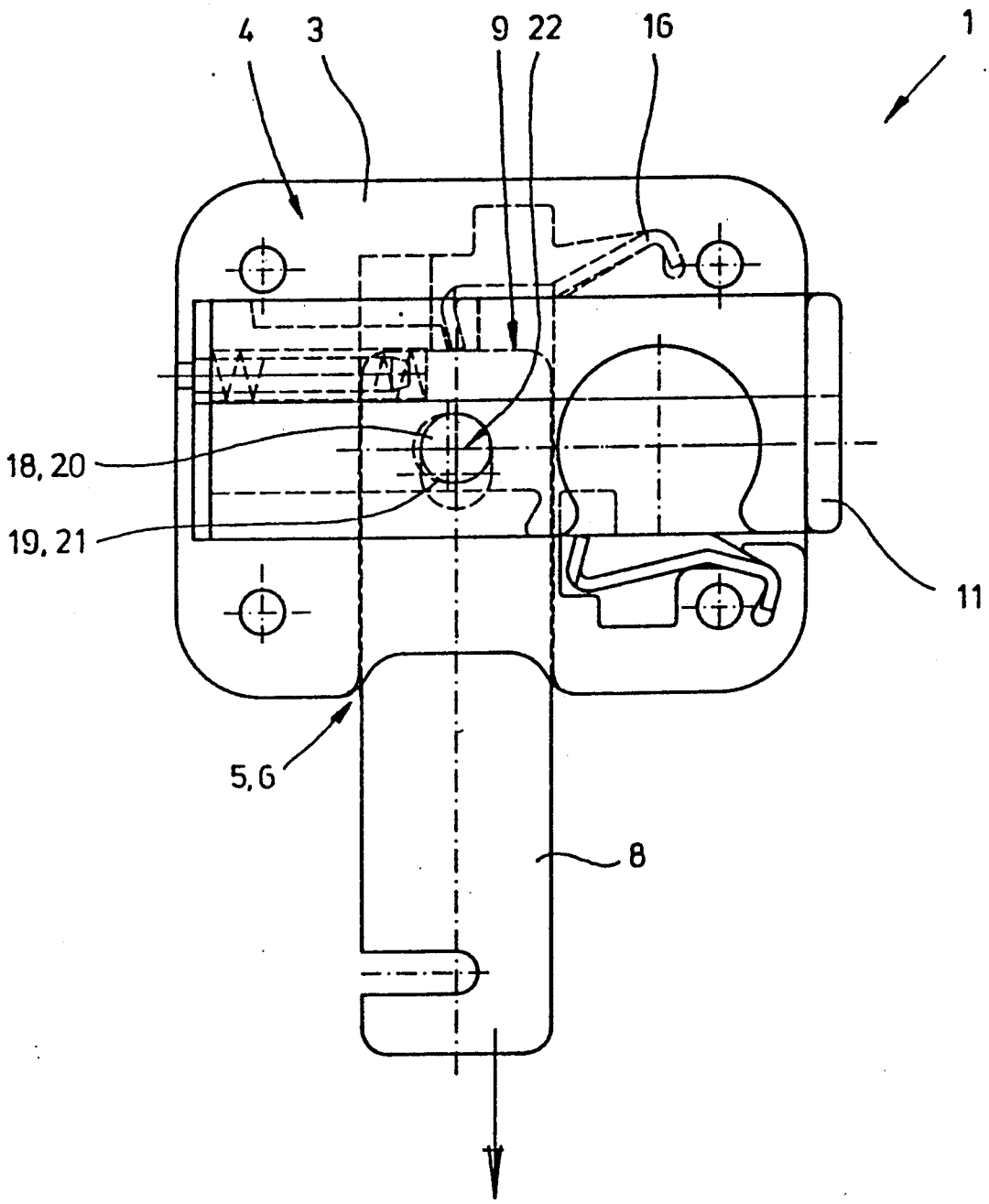
FIG. 2 shows the coin lock of FIG. 1 with the coin slide containing a coin and pushed into the lock.

The release or the disconnection of the coupling member 8 from the coin lock 1 is described with reference to FIG. 2. The coin slide 11 containing a coin can be seen in a position in which it has been pushed fully into the coin lock 1 and locked by means of the locking member 18. In this position the recess 20 on the underside of the coin slide 11 is situated precisely above the apertures 19 and 21 of the casing portion 3 and the coupling member 8. The apertures 19, 21 and the recess 20 now together form a larger space 22, the height of which is so great that under the action of a tensile force (see arrow) on the coupling member 8 the spherical locking member 18 is pressed upwards by the end wall of the aperture 21 of the coupling member 8, i.e. performs a yielding movement, so that the locking member 18, now resting on the top of the coupling member 8, is situated partially in the aperture 19 of the casing portion 3 and partially in the recess 20 of the coin slide 11. In order to facilitate movement of the locking member into and out of the aperture 21 the ends of the aperture 21 may be chamfered. The coupling member 8 can thus be completely withdrawn from the coin lock 1, and the locking member 18 again drops down, rests on the casing base 4 and partially projects into the aperture 19 of the casing portion 3. An improper withdrawal of the coin slide 11 is prevented by the locking member 16 engaged in the groove 15 in the coin slide 11. It is now possible to use the trolley, the coupling member 8 of which has been withdrawn from the coin lock 1.

Figure 3:
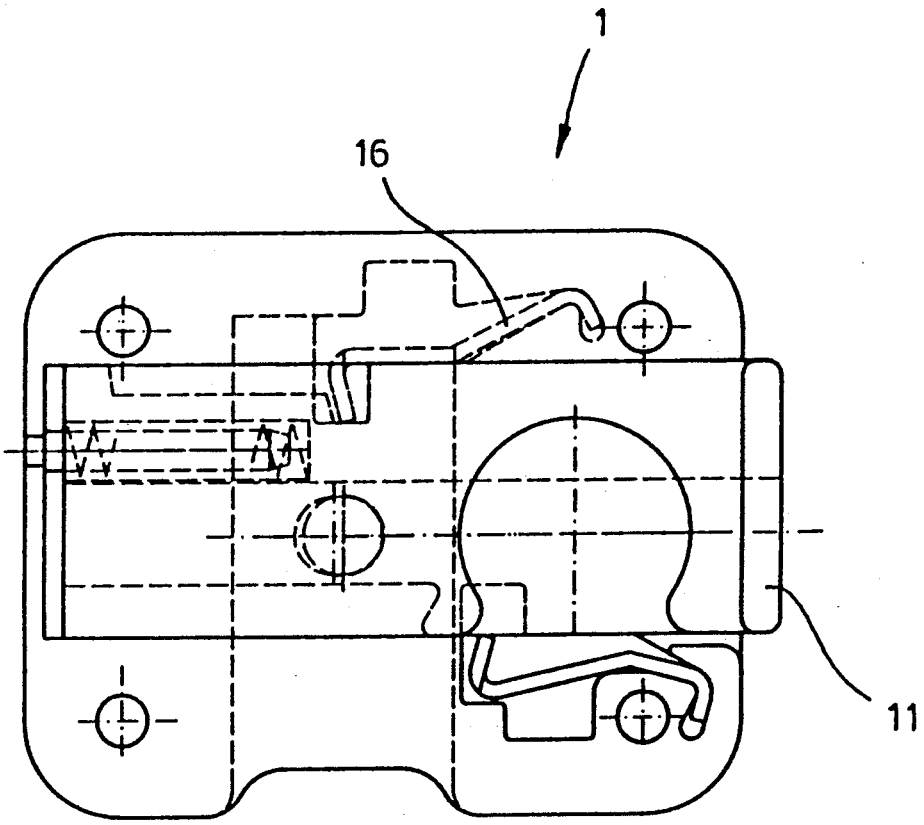
FIG. 3 shows the coin lock of FIG. 2 with the coupling member removed.

FIG. 3 shows the coin lock 1 without the coupling member 8 of an adjacent coin lock. As already mentioned with reference to FIG. 2, the coin slide 11 cannot be withdrawn, since this is prevented by the locking member 16. Consequently, the coin cannot be removed from the coin slide 11.

The attachment of a coupling member 8 to the coin lock 1 and the associated release of the coin are likewise described with reference to FIG. 2. The coupling member 8 is pressed (in the opposite direction to the arrow) through the opening 5 in the casing wall into the slot 6. When the coupling member 8 is inserted, its front end 9 presses the spherical locking member 18 upwards into the aperture 19 and the recess 20. As soon as the three spaces 19, 20 and 21 are in alignment in the intersection area, the spherical locking member 18 drops downwards under the action of gravity, so that it occupies the apertures 19 and 21, but no longer the recess 20 of the coin slide 11. If the coupling member 8 is pushed a little further in the direction opposite that of the arrow, which is possible on account of the elongate shape of the aperture 21, the coupling member 8 pushes the locking member 16 against the action of a spring (not shown) out of the slot 15, so as to release the coin slide 11. In so doing, the locking member 16 executes a small clockwise movement in FIG. 2. As soon as the coin slide 11 is released from the locking member 16, the coin slide 11 is pushed sufficiently far out of the casing 2 by the action of the compression spring 17 so that the coin can be removed again from the coin slide 11, whereas the coupling member 8 is firmly locked by the locking member 18 engaging the apertures 19 and 21.

The coin slide 11 is now ready to receive a coin once more to repeat the trolley releasing procedure.

We claim:

1. A coin lock for a trolley to hold two adjacent trolleys together, said coin lock having a slot for receiving a secondary coupling member from another trolley or from a collection point, said coin lock also having attached thereto a primary coupling member for insertion into the slot of another similar coin lock;

each said coin lock comprising:

a casing having a coin slide mounted for sliding movement in a guideway of said casing;

said coin slide having an outer end with at least one recess for receiving at least one coin, and an inner end extending into said casing and an opening in said coin slide near said inner end;

a coupling member slideway in said casing crossing said guideway in overlapping relationship so that said slideway and said guideway are on opposite sides of a common plane and defining an intersection area;

said coupling member slideway being for receiving a secondary coupling member removably mountable therein for movement from an inward locking position to an outward position where said secondary coupling member is removable from said slideway;

said secondary coupling member having an aperture positioned to align with said intersection area when said secondary coupling member is in its inward locking position;

a locking member captive within said intersection area but freely moveable therein and not attached to any part of said casing, said locking member being freely moveable in a path generally perpendicular to said common plane and having a height greater than the thickness of a secondary coupling member;

the arrangement being such that when a coin is in said recess and said coin slide is pushed into said guideway, the opening of the coin slide will align with the intersection area to permit said freely moveable locking member to move into said opening and out of the aperture in a coupling member, thus permitting such coupling member to be withdrawn from said casing.

2. The coin lock of claim 1 in which said locking member is in the form of a ball.

3. The coin lock of claim 1 in which said locking member is in the form of a cylindrical roller having semicircular ends.

4. The coin lock of claim 1 in which the aperture of the secondary coupling member has an elongate outline extending in the sliding direction of said coupling member.

5. The coin lock of claim 1 in which the aperture of the coupling member has walls which are chamfered to facilitate moving the locking member out of the aperture.

6. The coin lock of claim 1 in which the aperture of the secondary coupling member extends completely through said secondary coupling member.

7. The coin lock of claim 1 in which the opening near the inner end of the coin slide is in the form of an elongate recess extending in the direction of sliding of the coin slide.

8. The coin lock of claim 1 in which the thickness of the coupling member is slightly smaller than half the height of the locking member.

9. The coin lock of claim 1 including means adjacent said coin slide guideway for preventing a coin slide without a coin in each said recess from being pushed into the casing in a distance sufficient to align said opening with the intersection area but allowing said coin slide, when having a coin in each said recess, to be pushed into the casing a distance sufficient to align said opening with the intersection area.

10. The coin lock of claim 1 including a spring loading means positioned within said casing to be pushed to a loaded condition when said coin slide is pushed into said guideway.

11. The coin lock of claim 10 including means adjacent said coin slide guideway (a) to hold said coin slide in an inward position when said coupling member is removed and (b) to release said coin slide when said coupling member is reinserted.

12. A coin lock for a trolley to hold two adjacent trolleys together, said coin lock having a slot for receiving a secondary coupling member from another trolley or from a collection point, said coin lock also having attached thereto a primary coupling member for insertion into the slot of another similar coin lock;

each said coin lock comprising:

a casing having a coin slide mounted for sliding movement in a guideway of said casing;

said coin slide having an outer end with at least one recess for receiving at least one coin, and an inner end extending into said casing and an opening in said coin slide near said inner end;

a coupling member slideway in said casing and lying in a plane parallel to a plane of said guideway and crossing said guideway in overlapping relationship so that said slideway and said guideway are on opposite sides of a fixed portion of said casing which is interposed between said guideway and said slideway and defining an intersection area;

said coupling member slideway being for receiving a secondary coupling member removably mountable therein for movement from an inward locking position to an outward position where said secondary coupling member is removable from said slideway;

said secondary coupling member having an aperture positioned to align with said intersection area when said secondary coupling member is in its inward locking position;

a spherical locking member captive within said intersection area but freely moveable therein and not attached to any part of said casing, said spherical locking member being freely moveable in a path generally perpendicular to the planes of said guideway and said slideway and having a height greater than the thickness of said fixed portion;

the arrangement being such that when a coin is in each said recess and said coin slide is pushed into said guideway, the opening of the coin slide will align with the intersection area to permit said freely moveable locking member to move into said opening and out of the aperture in a coupling member, thus permitting such coupling member to be withdrawn from said casing.

13. The coin lock of claim 12 in which the aperture of the secondary coupling member has an elongate outline extending in the sliding direction of said coupling member.

14. The coin lock of claim 12 in which the aperture of the coupling member has walls which are chamfered to facilitate moving the locking member out of the aperture.

15. The coin lock of claim 12 in which the aperture of the secondary coupling member extends completely through said secondary coupling member.

16. The coin lock of claim 12 in which the opening near the inner end of the coin slide is in the form of an elongate recess extending in the direction of sliding of the coin slide.

17. The coin lock of claim 12 in which the thickness of the coupling member and the thickness of the interposed casing portion are each smaller, but together are slightly larger, than the diameter of said spherical locking member.

* * * * *